United States Patent [19]

Golben

[11] Patent Number: 4,505,120

[45] Date of Patent: Mar. 19, 1985

[54] HYDROGEN COMPRESSOR

[75] Inventor: Peter M. Golben, Wyckoff, N.J.

[73] Assignee: Ergenics, Inc., Wyckoff, N.J.

[21] Appl. No.: 453,109

[22] Filed: Dec. 27, 1982

[51] Int. Cl.[3] ..... F17C 11/00

[52] U.S. Cl. ..... 62/48; 34/15; 123/553; 206/0.7

[58] Field of Search ..... 62/48; 123/553; 206/0.7; 34/15

[56] References Cited

U.S. PATENT DOCUMENTS

| | | | |
|---|---|---|---|
| 3,704,600 | 12/1972 | Prast et al. | 62/457 |
| 3,732,690 | 5/1973 | Meijer | 62/553 |
| 4,165,569 | 8/1979 | Mackay | 62/48 |
| 4,188,795 | 2/1980 | Terry | 62/102 |
| 4,200,144 | 4/1980 | Sirovich | 165/1 |
| 4,393,924 | 7/1983 | Asami et al. | 62/48 |
| 4,396,114 | 8/1983 | Golben et al. | 206/0.7 |
| 4,402,187 | 9/1983 | Golben et al. | 62/48 |

OTHER PUBLICATIONS

"Molecular Absorption Cryogenic Cooler for Liquid Hydrogen Propulsion Systems" by G. A. Klein and J. A. Jones, pp. 1-6, AIAA/ASME 3rd Joint Thermophysics Fluids, Plasma and Heat Transfer Conference, Jun. 7-11, 1982, St. Louis, MO, (American Institute of Aeronautics and Astronautics, NY).

"Use of Vanadium Dihydride for Production of High--Pressure Hydrogen Gas", by D. H. W. Casters and W. R. David, pp. 667-674, Met. Hydrogen Syst. Proceedings, Miami, International Symposium, 1982.

*Primary Examiner*—Ronald C. Capossela

*Attorney, Agent, or Firm*—Charles E. Baxley

[57] ABSTRACT

A hydrogen compressor (10) having a hydride (26) suspended in a matrix (28). A cooling jacket (12) circumscribes the compressor (10) and a heater (22) is inserted within the compressor (10). A spring filter (30) is inserted within the compressor (10). A plurality of compressors (10A and 10B) are ganged together and are sequentially energized and deenergized by a plurality of timing means (72, 74A and 74B).

9 Claims, 3 Drawing Figures

HYDROGEN COMPRESSOR

TECHNICAL FIELD

This invention relates to compressors in general and, more particularly, to a compact hydrogen compressor and a system comprised therefrom operable on the temperate gradient formed between an electric heater disposed within the compressor and a coolant circulating about the compressor.

BACKGROUND ART

In the past few years there has been an increasing appreciation of hydrogen apart from its traditional chemical uses. Hydrogen is now seriously being considered for gas compression, solar heat storage, heating and refrigeration, utility peak load sharing, electrochemical energy storage, and as fuel for internal combustion engines.

Heretofore, the art has relied on mechanical compressors which tend to be noisy and wear out quickly because of high speed operation and difficulty with lubrication. There have been attempts in devising non-mechanical hydrogen compressors. See, for example, U.S. Pat. Nos. 4,200,144, 4,188,795 and 3,704,600. Moreover, I am the co-inventor of a compressor set forth in U.S. Pat. No. 4,402,187. Additional hydrogen compressor designs may be found in "Molecular Absorption Cryogenic Cooler for Liquid Hydrogen Propulsion Systems" by G. A. Klein and J. A. Jones, pages 1–6, AIAA/ASME 3rd Joint Thermophysics Fluids, Plasma and Heat Transfer Conference, June 7–11, 1982, St. Louis, MO (American Institute of Aeronautics and Astronautics, New York, NY) and "Use of Vanadium Dihydride for Production of High-Pressure Hydrogen Gas", by D. H. W. Casters and W. R. David, pages 667–674, Met. Hydrogen Syst. Proceedings, Miami, International Symposium, 1982.

In particular, I was faced with the problem of compressing hydrogen gas on a relatively small economic scale, yet still delivering acceptable pressures (500 psig [3.45 MPa]) and delivery rates (1800 ml/minute).

SUMMARY OF THE INVENTION

Accordingly, there is provided a hydrogen compressor and compressor system utilizing hydrides that when alternately heated by an electric heater and cooled by water (which can be ordinary tap water), will economically generate high hydrogen pressures at low flow rates.

PREFERRED MODE FOR CARRYING OUT THE INVENTION

Figure 1:
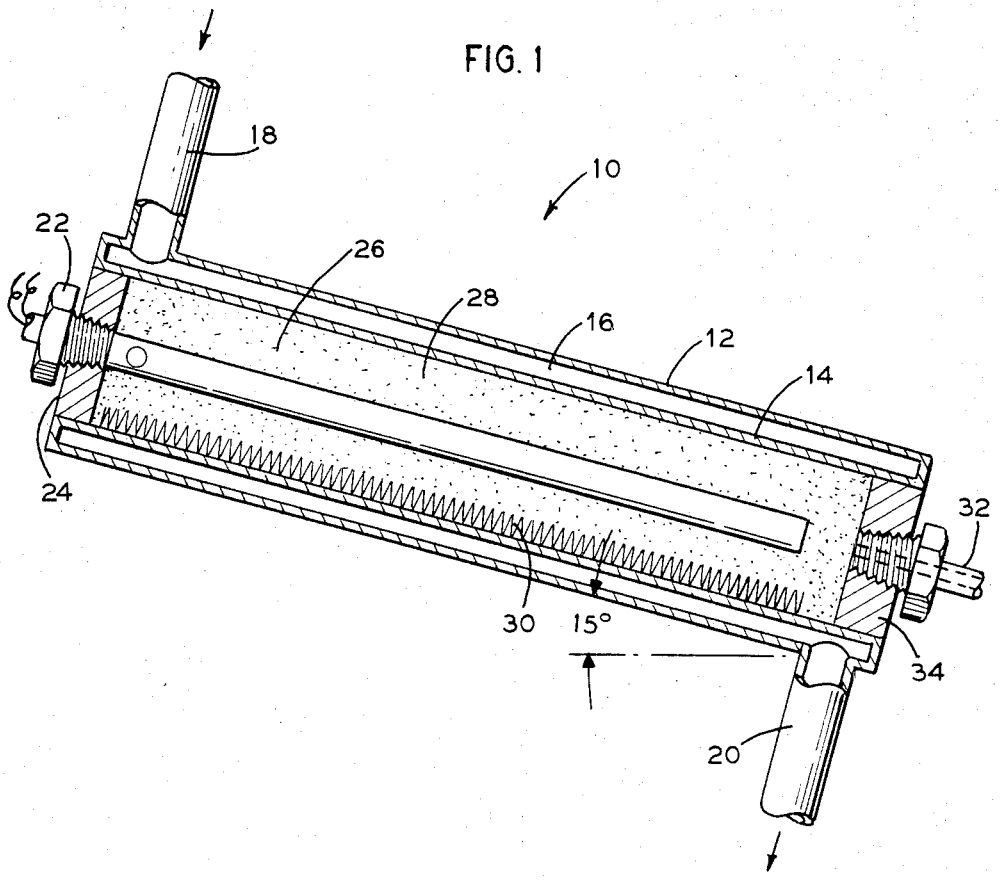
FIG. 1 is a cross sectional view of the invention.

Referring now to FIG. 1, there is depicted a hydrogen compressor or reactor 10. The compressor 10 includes cooling jacket 12 spatially circumscribing a hydride container 14. An annular space 16 formed between the jacket 12 and the container 14 provides a cooling fluid passage. Conduits 18 and 20, affixed to the jacket 12 provide cooling fluid access to and from the reactor 10.

An electric cartridge heater 22 extends through a plug 24 and into the container 14 and is attached thereto. Hydridable material 26, suspended in an aluminum foam matrix 28, is packed into the container 14 about the heater 22. An axial spring filter 30 is disposed within the container 14 to absorb the appreciable expansion forces generated by the hydride 26 as it controls hydrogen. Without the spring filter 30, the expanding hydride 26 may very well crack and damage the compressor 10.

A hydrogen input/output line 32, sealingly fitted through a plug 34, communicates with the interior of the container 14.

Figure 2:
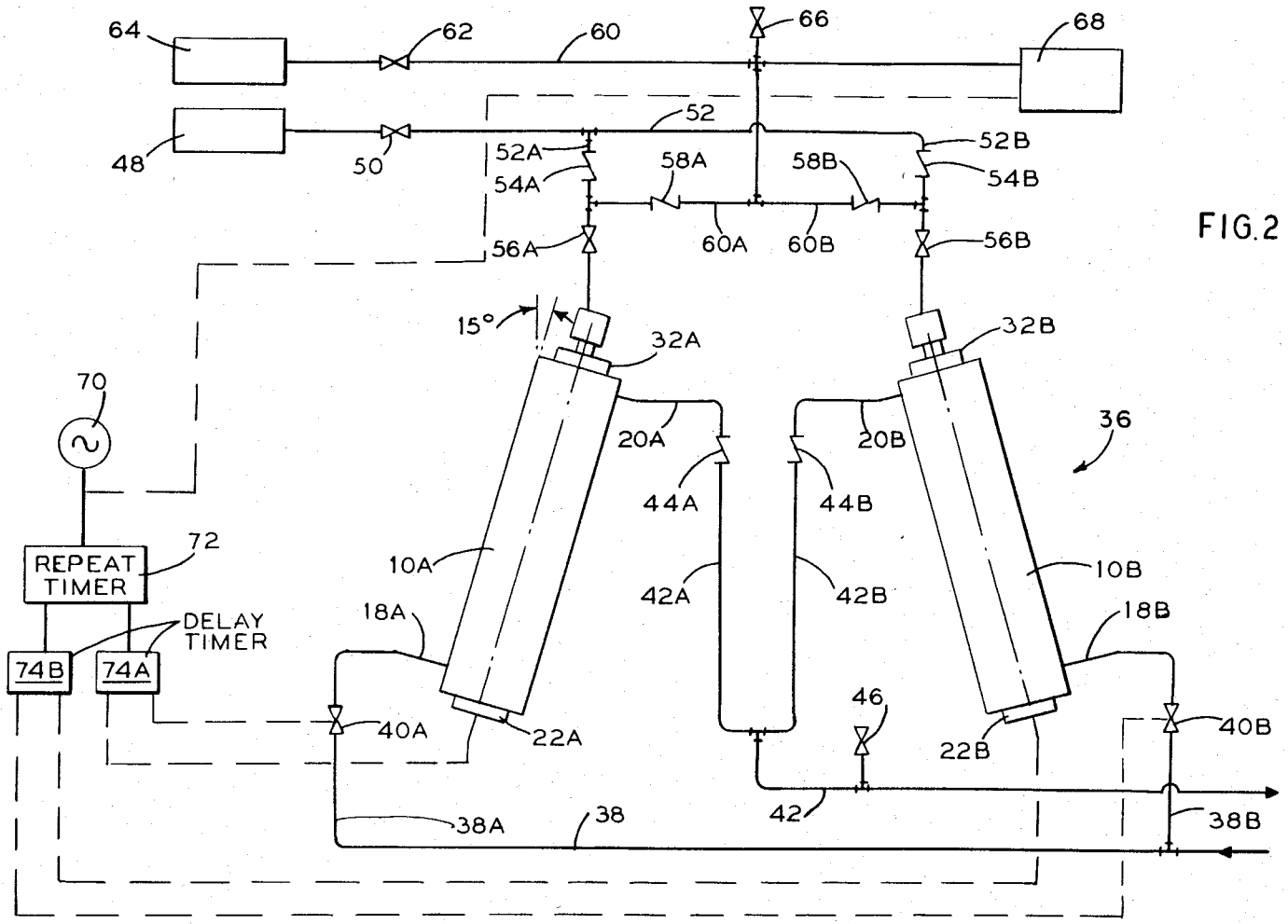
FIG. 2 is a schematic view of the invention.

FIG. 2 depicts a schematic view of a hydrogen compressor system 36 utilizing two compressors 10 connected together in a push/pull fashion. Simply for ease of discussion, one reactor is labeled with an "A" suffix (10A) and the other reactor is affixed with a "B" suffix (10B). Associated components will carry the "A" or "B" designation as well.

Coolant input line 38 passes a cooling fluid, preferably ordinary demineralized tap water, into the compressors 10A and 10B via lines 38A and 38B.

Solenoid valves 40A and 40B modulate the quantity of coolant fed into the cooling jackets 12 of the compressors 10A and 10B. Coolant output line 42, via lines 42A and 42B draws off coolant from the compressors 10A and 10B through one-way valves 44A and 44B. Safety valve 46 will open should the pressure within the line 42 exceed a predetermined value.

Hydrogen is supplied to the system 36 from low pressure supply means 48. Means 48 could be a tank, an electrolyzer, etc. Valve 50 regulates the quantity of hydrogen introduced into the system 36 via lines 52, 52A and 52B. One-way valves, 54A and 54B, are disposed within the lines 52A and 52B respectively. Another series of valves, 56A and 56B, control the quantity of hydrogen flowing into and out of compressors 10A and 10B. One-way valves, 58A and 58B, permit the flow of hydrogen out of the compressors 10A and 10B into output line 60 via output lines 60A and 60B. Valve 62 regulates the quantity of hydrogen entering high pressure storage means 64. Relief valve 66 monitors the pressure within the output line 60. Overpressure switch 68 is designed to turn the system 36 off in the event that the pressure output is above a predetermined value.

The control means for switching the heaters and solenoids on and off is also schematically depicted in FIG. 2. Current source 70 supplies power to repeat timer 72. The repeat timer 72, in turn is connected to delay timers 74A and 74B. Each delay timer (74A and 74B) is electrically associated with its respective solenoids (40A and 40B) and heaters (22A and 22B).

Figure 3:
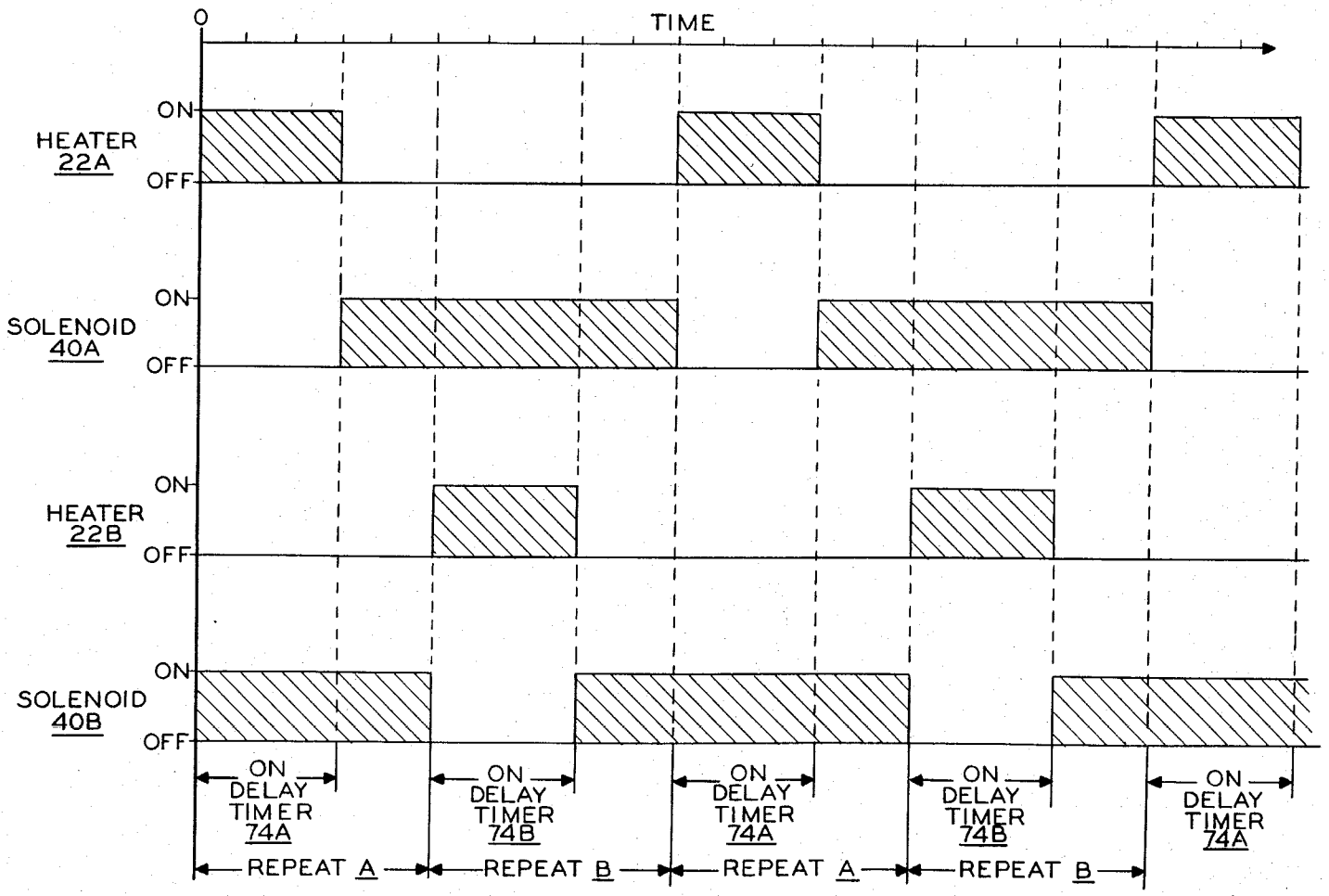
FIG. 3 is a timing diagram for the invention.

FIG. 3 depicts a timing sequence for energizing and deenergizing the system 36. The staggered timing circuit enables the inlet hydrogen supply flow via line 52 to remain fairly constant. The push-pull nature of the system 36 is necessary when the reactors 10A and 10B are compressing the hydrogen being supplied by, say, an electrolyzer 48. Should the hydrogen flow be erratic, subject to pressure swings and cessations, the electrolyzer 48 would shut down due to the ensuing back pressure rise in line 52. The repetitive start up and shut down of the electrolyzer 48 would cause undesirable wear and tear on same. Accordingly, the system 36, by utilizing a small simultaneous cooling cycle overlap for each reactor, provides a continuous, uninterrupted flow of hydrogen gas to and from the reactors that eliminates the need for an input gas accumulator that is normally associated with a mechanical compressor.

The abscissa of FIG. 3 represents time whereas the ordinate represents an on-off state for the heaters (22A and 22B) and solenoids (40A and 40B). Each heater (22A and 22B) and solenoid (40A and 40B) is sequentially switched on and off in a staggered, repetitive manner.

For ease of discussion it will be assumed that when power is first applied to the system 36 (time equaling 0), the repeat timer 72 will energize the delay timer 74A first. This is simply a convention and is not meant to be a limiting example. Therefore, according to FIG. 3 (and FIG. 2), heater 22A and solenoid 40B are powered up. Due to heating in the compressor 10A, the hydrogen is compressed to a predetermined value (say 500 psig [3.45 MPa]) and passes out through valve 58A and into the storage means 64 via line 60. Simultaneously cooling water starts flowing past solenoid valve 40B and cools down the hydride bed 28 in compressor 10B. When the pressure in compressor 10B drops below a predetermined value (say 60 psig [0.41 MPa]), one-way valve 54B opens and hydrogen from the source 48 is absorbed in the hydride.

After a preset time interval (in the example shown three time units), the delay timer 74A will turn off (deenergize) heater 22A and turn on (energize) the solenoid 40A. This allows the just heated hydride bed 28 to cool down and start absorbing hydrogen while the hydride bed 28 in compressor 10B is still absorbing hydrogen. After a preset time, the repeat timer 72 will switch and solenoid 40B will close and the heating of the hydride bed 28 in reactor 10B will commence. Hydrogen now stored in the hydride bed 28 of reactor 10B is pressurized to a predetermined value (say 500 psig [3.45 MPa]) due to heating and passes through the valve 58B and on into the high pressure storage tank 64. At this same time hydrogen is passing through the valve 54A and entering the hydride bed 28 of reactor 10A which is being cooled. After a preset time delay by delay timer 74B heating of the hydride bed 28 in reactor 10B will cease and solenoid 40B will open thereby cooling down the hydride bed 28 in reactor 10B and allowing it to start absorbing hydrogen again. At this point the timer cycles repeat themselves and the heating and cooling cycles being anew.

The aluminum mesh 28 used to contain the hydride powder has been found to greatly increase the heat transfer through the powdered bed made from hydridable material 26 and thus increase the compressor's 10 efficiency and thus decrease the mass of hydride alloy needed. The aluminum mesh 28 has also been found to effectively control the adverse effects of hydride expansion that is known to have detrimental effects on such equipment.

The axial spring filter 30 allows hydrogen gas to easily transverse the entire length of the compressor 10 and thus intermingle with nearly all of the hydride immediately. This also increases heat transfer characteristics and reduces the problem of hydride expansion.

It is preferred to tilt the compressors 10A and 10B about 15 degrees from the horizontal. As the hydride heats up via the heater 22, temperatures in excess of 212° F. (100° C.) will be reached, thus vaporizing any water in the cooling jacket 12. The vapor will tend to rise to one corner of the compressor 10 due to the angle of inclination, while simultaneously displacing any remaining water out through valves 44A and 44B. The valves, 44A and 44B, will prevent any coolant from back flowing into the reactor 10. Tilting of the compessor 10 adds to the overall efficiency of operation.

The timers 72, 74A and 74B may be mechanical, electromechanical or solid state devices.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privlege is claimed are defined as follows:

1. A hydrogen compressor, the compressor comprising a cooling jacket, the jacket circumscribing a container, hydridable material disposed within the container, means for heating the compressor disposed within the container, a spring filter disposed within the container for absorbing expansion of the hydridable material disposed within the container, an input/output line for introducing and withdrawing hydrogen into and from the container, the hydridable material suspended in an aluminum foam matrix, and conduit means for introducing and withdrawing coolant into and from the jacket.

2. A system for compressing hydrogen, the system comprising a plurality of hydrogen reactors, a source of coolant to the reactors, a coolant drain from the reactors, a source of hydrogen to the reactors, a hydrogen drain from the reactors, a coolant valve diposed upstream coolant flow-wise of each reactor, a heater for heating each reactor, first timing means registered to a plurality of second timing means, the second timing means registered with a respective coolant valve and a heater, and the first and second timing means programmed to sequentially energize and deenergize the valves and heaters so as to provide a dump for the hydrogen from the source of hydrogen to the reactors and a continuous compressed supply of hydrogen to the drain from the reactors.

3. The system according to claim 2 wherein a first coolant valve and first heater are associated with a first reactor and a second valve and second heater are associated with a second reactor, the first and second timing means timers programmed to:

(1) energize the first heater and second valve,
(2) after a predetermined time energize the first valve,
(3) after a predetermined time energize the second heater and deenergize the second valve,
(4) after a predetermined time, deenergize the second heater and energize the second valve,
(5) after a predetermined time energize the first heater and deenergize the first valve, and
(6) repeat steps 2 through 5.

4. The system according to claim 2 wherein the reactors are tilted about fifteen degrees from the horizontal.

5. The system according to claim 2 wherein a plurality of one-way valves are disposed between the hydrogen source and the reactors to prevent hydrogen from backflowing into the hydrogen source.

6. The system according to claim 2 wherein a plurality of one-way valves are disposed between the hydrogen drain and the reactors to prevent the hydrogen from backflowing into the reactor.

7. The system according to claim 2 wherein the hydrogen reactors include a cooling jacket, the jacket circumscribing a container, hydridable material disposed within the container, the heater disposed within the container, means for absorbing expansion of the hydridable material disposed within the container, an input/output line for introducing and withdrawing hydrogen into and out of the container and connected to the hydrogen source and drain, and conduit means for introducing and withdrawing coolant into and from the jacket and connected to the coolant source and drain.

8. The system according to claim 2 wherein the hydridable material is suspended in an aluminum matrix.

9. The system according to claim 2 wherein a spring filter is disposed within the container.

* * * * *